United States Patent [19]

Smith

[11] 3,942,418

[45] Mar. 9, 1976

[54] APPARATUS FOR HELICALLY WINDING CONTAINER BODIES

[75] Inventor: Curtis J. Smith, Fenton, Mo.

[73] Assignee: Container Corporation of America, Chicago, Ill.

[22] Filed: Mar. 21, 1975

[21] Appl. No.: 560,799

[52] U.S. Cl. ..... 93/80; 93/77 R

[51] Int. Cl.[2] ..... B31C 3/00

[58] Field of Search..... 93/80, 77 R, 94 R; 83/289; 82/100; 156/425, 429

[56] References Cited

UNITED STATES PATENTS

| | | | |
|---|---|---|---|
| 2,623,443 | 12/1952 | Robinson | 93/80 |
| 2,699,099 | 1/1955 | Robinson | 93/80 |
| 3,150,575 | 9/1964 | Couzens et al. | 93/80 |

*Primary Examiner*—James F. Coan
*Attorney, Agent, or Firm*—Carpenter, Ostis & Lindberg

[57] ABSTRACT

A machine for producing helically wound tubular bodies from patterned strip material where the strip material is wound on a mandrel to form an axially movable tube having recurring indicia thereon marking points where the tube is to be cut into discrete lengths at the recurring indicia includes a carriage having a knife array movable into position to cut the tube into the discrete bodies, the carriage being movable axially with respect to the axially movable tube and into synchronization therewith, the carriage supporting structure for sensing one of the recurring indicia and controlling the speed of winding of the tube so that the knife array cuts the tube into discrete bodies at the recurring indicia.

The machine is further characterized by a pair of such carriages which move axially to and fro, the two carriages being locked together and released from locking for traverse of the carriages between advanced and retracted positions.

7 Claims, 13 Drawing Figures

ONE SET OF KNIVES DISENGAGED
DOCKING PIN ENGAGED

APPARATUS FOR HELICALLY WINDING CONTAINER BODIES

BACKGROUND OF THE INVENTION

1. Field of the Invention

Helically wound container bodies having helically wound labels thereon have long been known, but by reason of printing errors on the label strips, varying winding speeds, conditions of varying humidity or the like, the wound label changes in dimension and it has been difficult to achieve bodies of substantially identical appearance, label misregistration being the principal problem.

Heretofore misregistration correction has been achieved by cutting trim rings from a stick of wound container bodies, the trim ring being wasted, altogether not too desirable.

2. The Prior Art

The most pertinent art relating to the problem appears to be exemplified in the following U.S. Pat. Nos. developed in a search:

| | | |
|---|---|---|
| Robinson et al | 2734432 | Cl 93/80 |
| Glasby | 3133483 | " |
| Glasby | 3139011 | " |
| Glasby | 3150574 | " |
| Couzens et al | 3150575 | " |
| Brigham | 3158074 | " |
| Brigham | 3220320 | " |
| Yovanovich | 3229598 | " |
| Lindberg | 3636827 | " |
| Woelbel | 3664239 | " |

SUMMARY OF THE INVENTION

The invention herein relates to a machine for helically winding tubular bodies having identical intelligence thereon in such a fashion that the winding errors introduced by aberrations in the winding strip are automatically compensated for. This is accomplished by cutting the individual bodies into discrete lengths before the errors in the wound strip have accumulated to an extent whereby a large error has occurred, by sensing recurring indicia in the wound label strip, correcting the winding and the advance thereof, so that severing into discrete bodies occurs before large cumulative errors have occurred.

THE DRAWINGS

FIG. 1 is a schematic plan view of a helically wound container body winding machine illustrating the invention;

FIG. 1*a* is a similar view illustrating operation of the structure according to the invention;

FIG. 1*b* is a view similar to FIG. 1*a* illustrating another step in operation;

Figures 1, 1A, 1B:
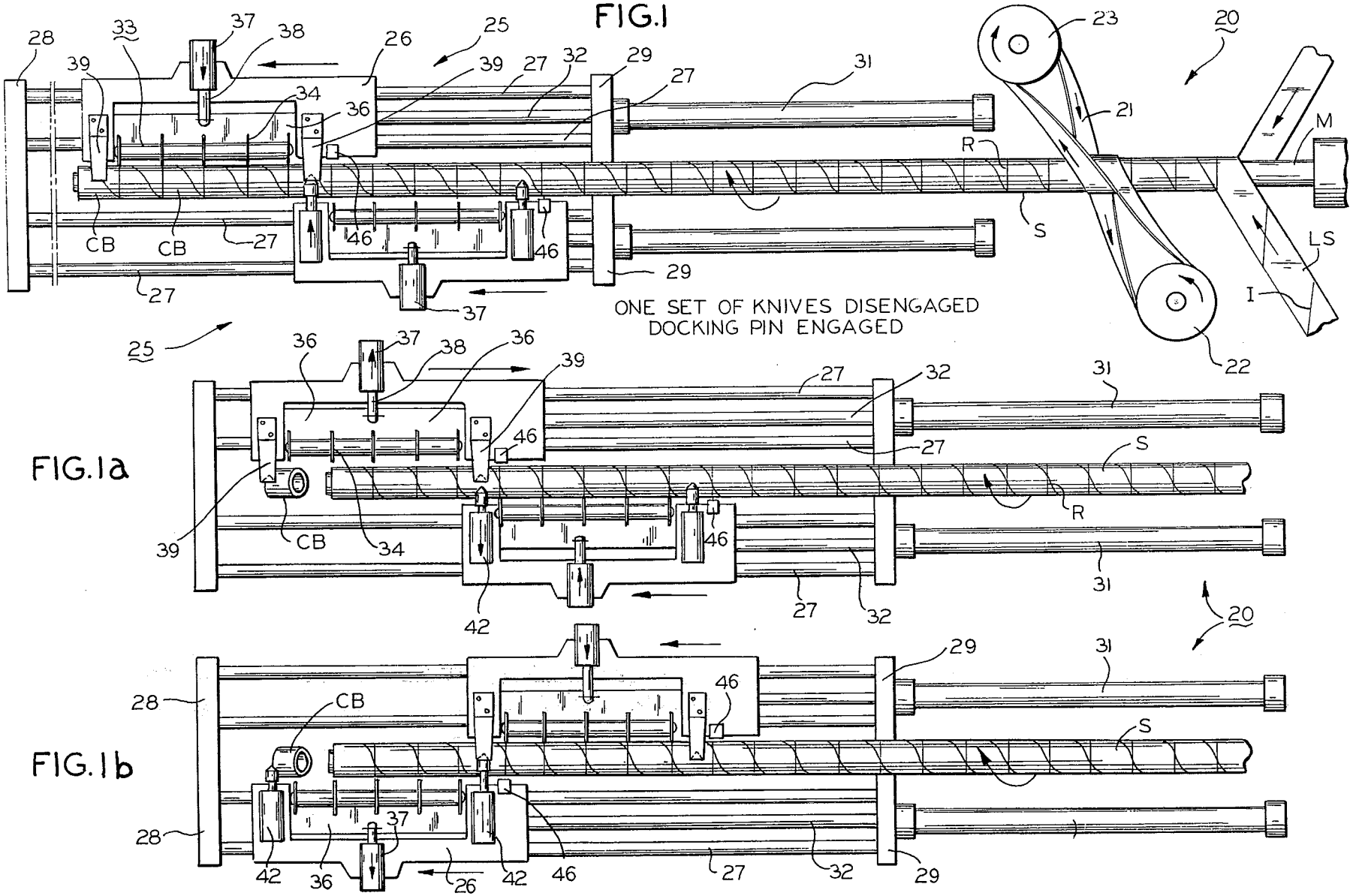
Figure 2:
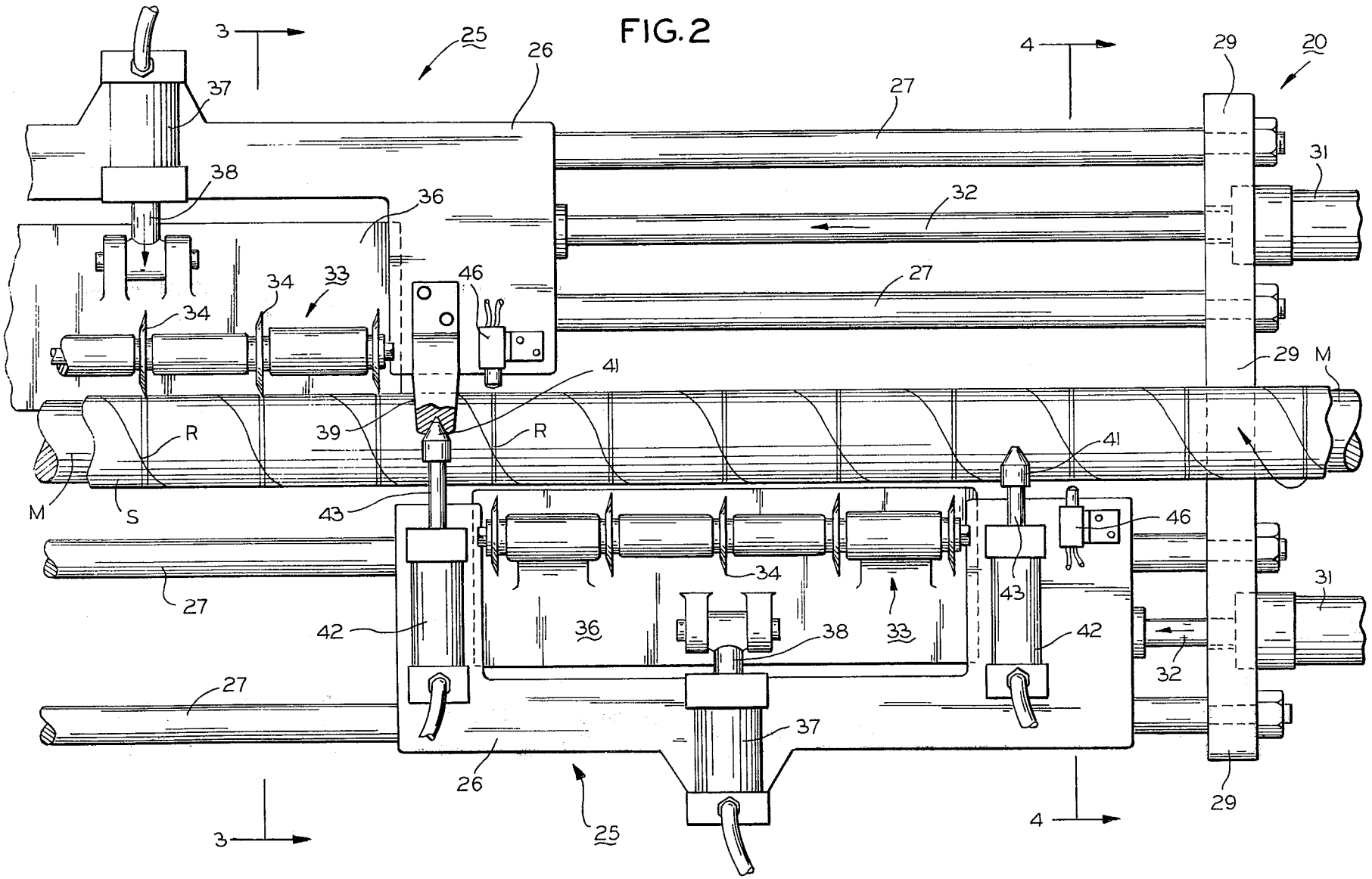
FIG. 2 is a detailed plan view of the apparatus seen in the preceding views.
Figure 3:
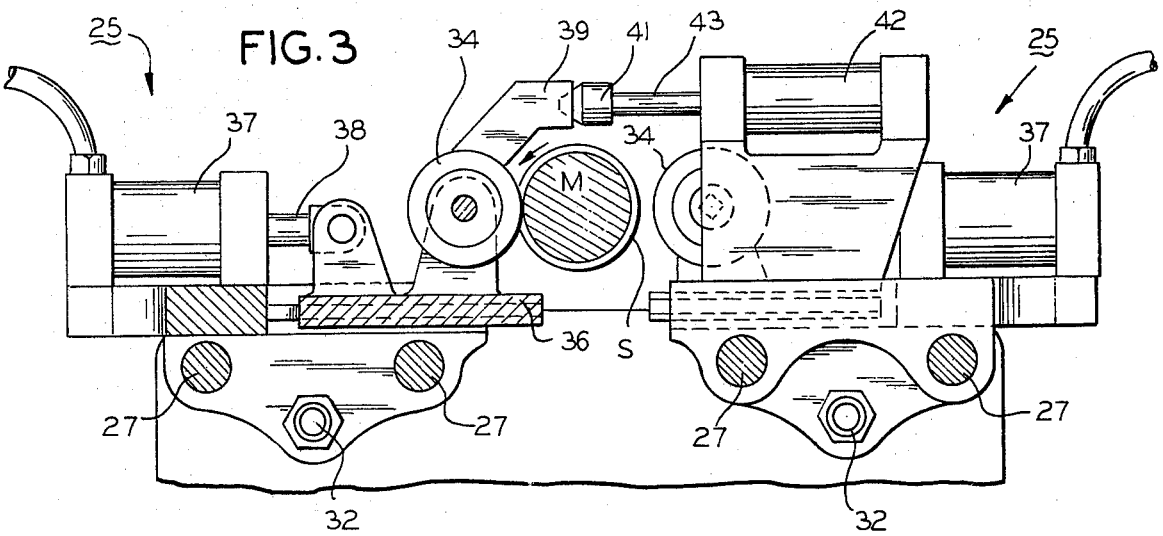
FIG. 3 is an elevational view taken along the line 3—3 of FIG. 2 looking in the direction of the arrows.
Figure 4:
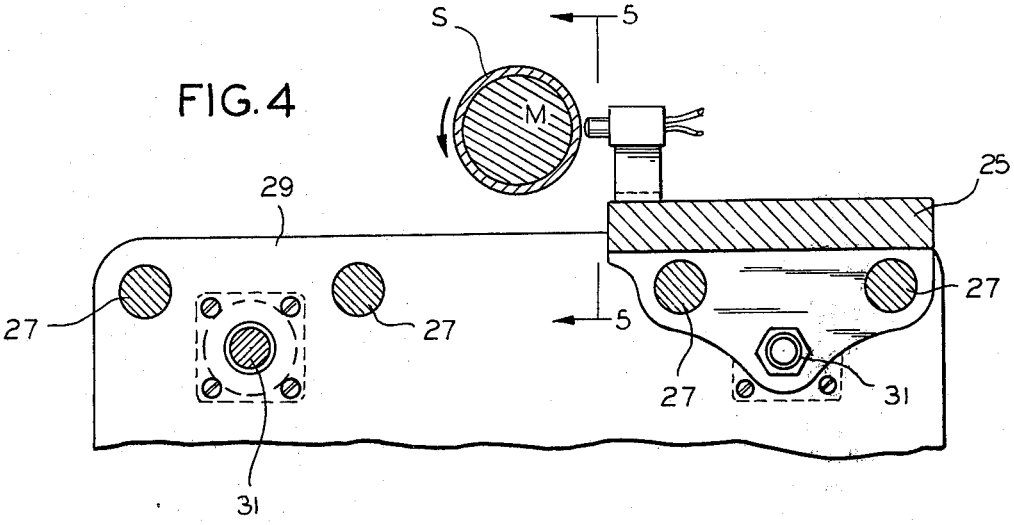
FIG. 4 is a transverse sectional view taken along the line 4—4 of FIG. 2 looking in the direction of the arrows.

The apparatus according to the present invention is denoted generally by the reference numeral 20 and includes structure for winding a label strip LS on a mandrel M. Label strip LS has recurring intelligence I thereon in the form of a strip which may have a width of the order of 0.090, a practice common in the art.

Label strip LS may have other intelligence thereon, and when same is wound on mandrel M the intelligence I forms an eye track R, the distance between such eye tracks marking the dimension of a container body CB on the mandrel M, and label strip LS may be adhered to base laminae previously formed on mandrel M. Label strip LS may be formed of additional laminae which may be glued along the edges thereof to define such stick, if desired. If the stick is formed of base laminae covered by a label strip the speed of advance of the base laminae will be controlled similarly to the speed of advance of the wound label strip LS.

Formation of the stick and advance thereof along mandrel M is achieved by a belt 21 trained about pulleys 22 and 23, a reach of belt 21 being wrapped about the helically wound label strip LS and mandrel M to advance wrapped label strip LS along mandrel M.

The recurring spaced eye tracks in the form of rings R mark the dimensions of discrete tubular bodies CB which are cut from stick S. By reason of aberrations in label strip LS, and the winding of same upon mandrel M, the stick S would have resultant cumulative errors giving rise to variations in appearance of the discrete bodies cut from the stick.

According to the present invention the eye tracks R are sensed continuously along the stick S, and sensing structure is operable to control the advance of the stick S along mandrel M in such a fashion that the individual bodies are severed only along eye tracks R. In order to correct for any aberrations in the winding, the severing of the stick into individual bodies CB is achieved by a pair of cut-off carriages each sensing a ring R and controlling such advance, the carriages being mounted on opposite sides of the advancing stick S and having advancing and retracting motions in sequential order longitudinally of stick S. The carriages are each provided with "docking" devices whereby they move in unison for a part of their operation, the docking being alternately released and engaged in accordance with the advance and retraction of the carriages.

Referring now particularly to FIGS. 1 to 1B inclusive, advancing stick S is severed into the discrete bodies CB by identical cut-off carriages, each referred to generally by reference numeral 25, each being mounted to a side of the advancing stick S.

Each carriage 25 includes a frame 26 mounted for sliding movement upon pairs of spaced rails 27 flanking the advancing stick S and supported on longitudinally spaced abutments 28, 29. Movement of each frame 26 along the rails 27 is achieved by a cylinder 31 secured to abutment 29 and having a piston rod 32 secured to frame 26.

Each carriage 25 supports a knife array 33 including spaced cutter knives 34 mounted on a support 36 slidable laterally of stick S by a cylinder 37 fast on carriage 25 and having a piston rod 38 connected to support 36. Control of the cylinder 37 is achieved by circuitry, not shown, for such purpose and timed in accordance with the positions of carriage 25.

One of the carriages 25 has longitudinally spaced female docking devices 39 adapted to cooperate with male docking devices 41 of an opposite carriage 25, the latter being movable into docking relationship with female docking device 39 by a cylinder 42 mounted on the other carriage 25, and having a piston rod 43 supporting docking device 41, and movable between docking and undocking positions.

Figure 5:
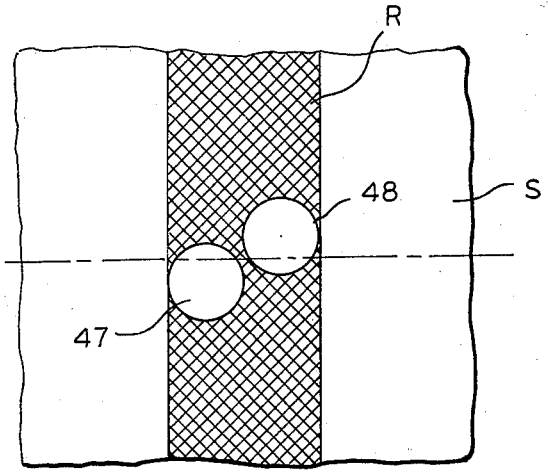
FIG. 5 is an elevational view, to an enlarged scale, looking in the direction of the arrows 5—5 of FIG. 4.

Each of the carriages 25 includes a sensor 46, each including spaced photo-electric devices or eyes 47 and 48, see FIG. 5, adapted to sense ring R on stick S. The function of eyes 47 and 48 is to control the speed of advance of stick S by controlling the driving speed of belt 21. It is driven by a motor 49, see FIG. 6, through a speed reducer 51 having an output shaft 52 fast to pulley 22. Speed reducer 51 is controlled by an arm 53 varied in its speed controlling position by control windings 54 and 56, an armature 57 being connected to control arm 53 and being movable by said windings.

The cells 47 and 48 are arranged to sense the ring R in such a fashion that carriage 25 is locked in with the rings R so that the cutter knives 34 cut along each ring R. If, for example, the speed of carriage 25 and the advance of stick S drifts, the eyes 47 and 48 with control circuitry make an appropriate speed correction to the winding belt 21. Also, for example, if eye 47 moves from ring R it will activate a circuit 58 to increase the speed of speed reducer 51. If eye 48 on carriage 25 drifts back and off ring R indicating too high a speed of advance of stick S with respect to carriage 25, eye 48 activates a circuit 59 to decrease the speed of winding belt 21.

Figure 6:
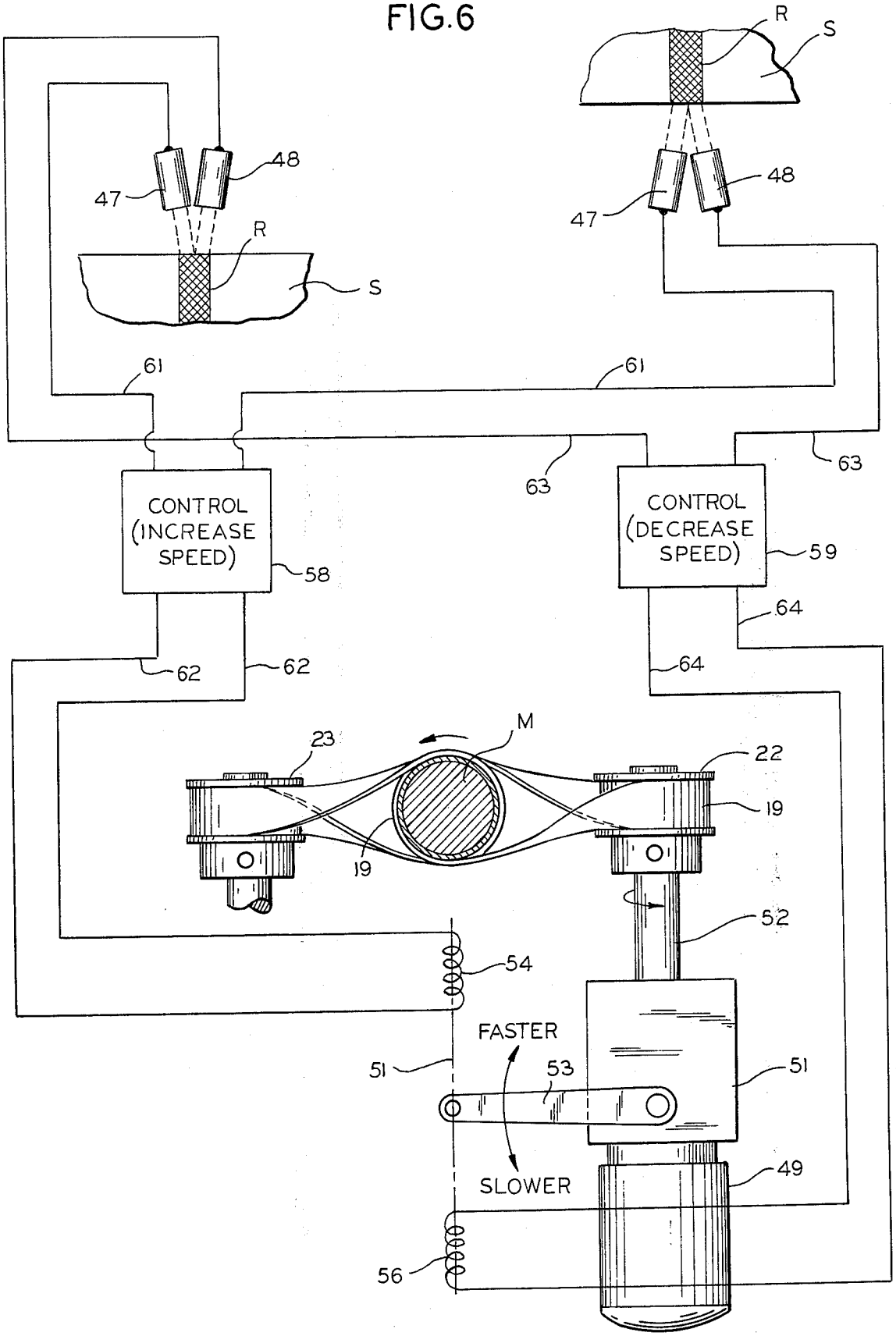
FIG. 6 is a view showing structure for controlling the speed of winding of the label strip.

As seen in FIG. 6 eyes 47 are connected in parallel leads 61 to circuit 58, it having leads 62 therefrom to solenoid 54. Eyes 48 have parallel leads 63 therefrom to circuit 59, it having leads 64 to solenoid 56.

The structure according to the present invention is characterized by at least one of the carriages 25 being "locked on" to the advancing stick S and being operable for its knife array 33 to cut the leading end of the advancing stick S into discrete bodies CB. The invention is also characterized by the other carriage being locked in to the one carriage by the docking structure, so that it is "locked on" to the advancing stick both during and after the one carriage has completed its cutting function and has been undocked from the other carriage to retract and resume its subsequent operations.

Figure 7:
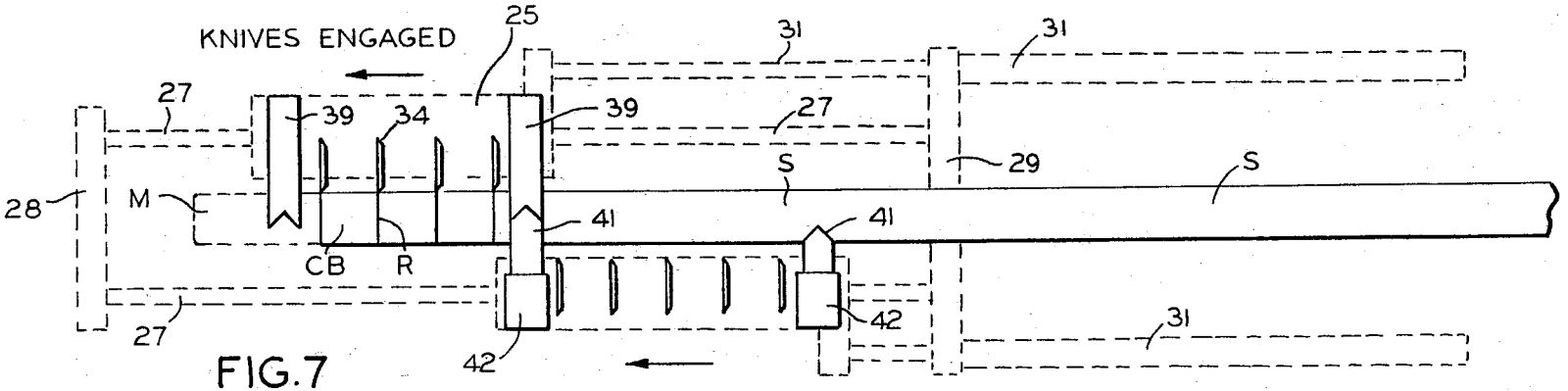
FIGS. 7 to 11 inclusive are schematic representations showing sequences of operation of the apparatus according to the present invention.
Figure 8:
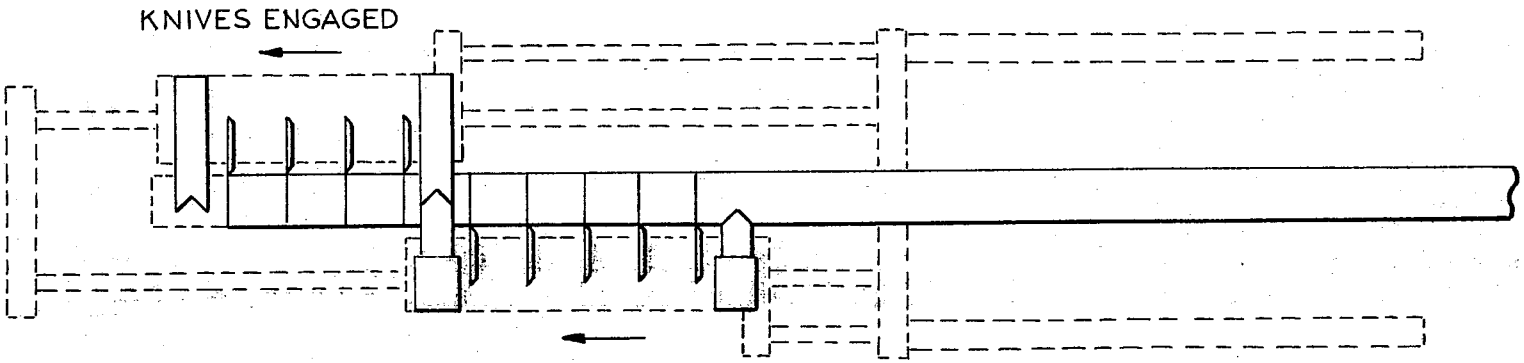

The sequence is best understood with reference to FIGS. 7 to 11 inclusive, which illustrate the sequences obtaining. FIG. 7 shows the two carriages in docked relationship and in synchronism with the advancing stick with the cutter arrays 43 in register with rings R. FIG. 8 shows the other carriage 25 docked with the one carriage to cut stick S into discrete bodies CB. The cylinders 37 have been actuated in each case to move the knife array against stick S to sever same. Circuitry for controlling cylinder 37 is under the control of additional circuitry, not shown, for controlling cylinders 31 in the movement of carriages 26 in their movement to synchronize with the advance of stick S. Such circuitry forms no part of the present invention.

Figure 9:
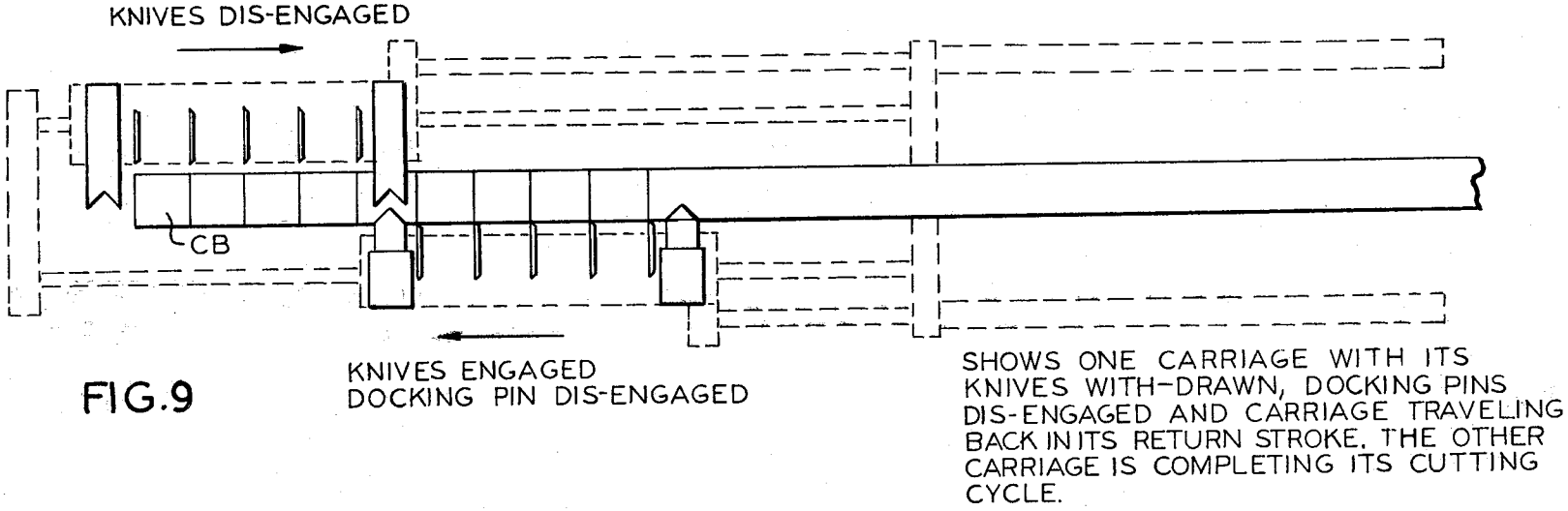

FIG. 9 shows the one carriage 25 as having completed its operation to sever stick S, male and female docking structures 39 and 41 being disengaged, and the one carriage 25 being retracted by cylinder 31 coacting therewith. Other carriage 25 is locked in with its sensor 46, see FIGS. 1 to 1B, and continues its advance in synchronism with advancing stick S to sever same into bodies CB which drop from mandrel M at the end thereof. It, like the one carriage, has its knife array 33 moved into cutting position by its cylinder 37.

Figure 10:
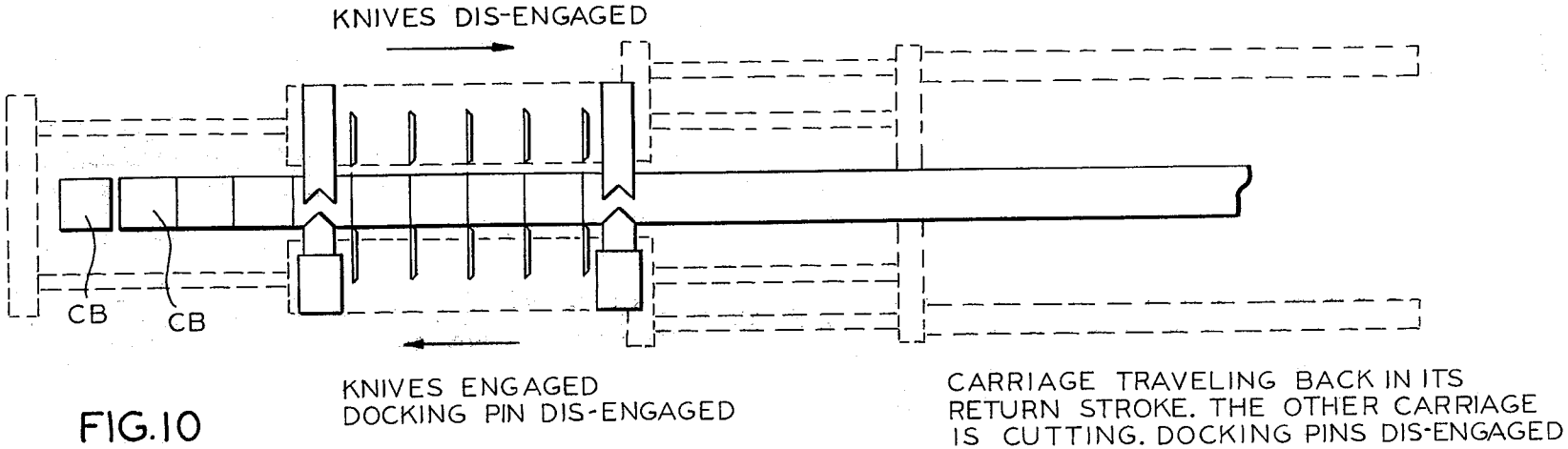

FIG. 10 shows the one carriage 25 in its retracting movement, the other carriage continuing its advance with the advancing stick S and severing the same into the bodies CB.

Figure 11:
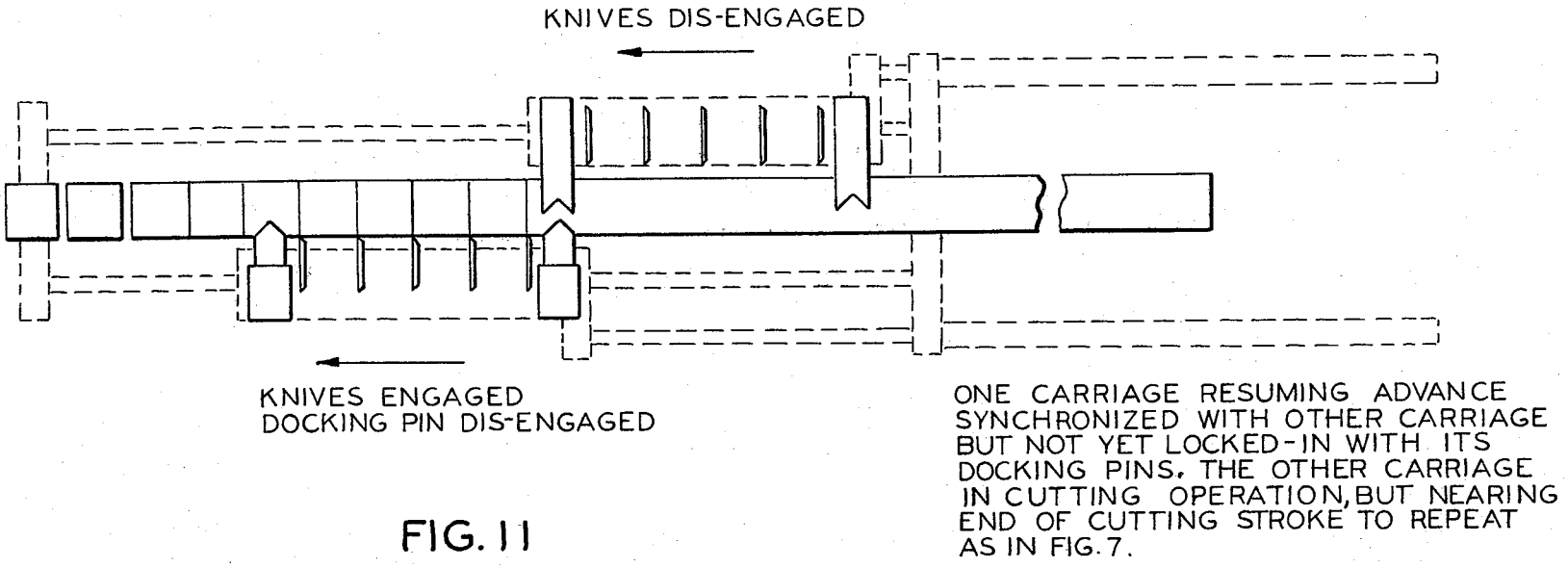

FIG. 11 shows the one carriage in its retracted position ready to dock with the other carriage and to advance with same to repeat a sequence as seen in FIG. 7. Sensing of the eye tracks R takes place as before, and movement to cutting position of its array 33 takes place after the docking operation takes place.

I claim:

1. A machine, for the production of helically wound tubular bodies from strip material, comprising:

a. means for winding strip material on a mandrel to form a tube having recurring registration indicia thereon and for moving the tube axially along the mandrel;

b. a pair of carriages each having a knife array thereon and being independently movable into position to cut said tube into individual bodies along the registration indicia between each body;

c. means for moving each of said carriages axially with respect to said axially movable tube and into synchronism therewith;

d. means for moving said knife array against said tube when the carriage having said knife array is synchronized in speed with said axially moving tube;

e. means for sensing said indicia;

f. means operable in response to said sensing means for varying the speed of advance of said axially movable tube whereby said knife array cuts said tube on the registration indicia without the formation of waste in said tube.

2. The machine according to claim 1 wherein said carriages include means for maintaining said carriages in relationship for movement in unison by means for docking said carriages in such relationship.

3. The machine according to claim 2 wherein said carriages includes a docking structure engageable with a mating docking structure on the other carriage.

4. The machine according to claim 1 wherein said carriages are movable longitudinally of said axially movable tube between advanced and retracted positions.

5. A machine, for the production of helically wound tubular bodies from strip material, comprising:

a. means for winding strip material on a mandrel to form a tube having recurring registration indicia thereon and for moving the tube axially along the mandrel;

b. a pair of carriages each having a knife array thereon and being movable into position to cut said tube into individual bodies along the registration indicia between each body;

c. means for moving each of said carriages axially with respect to said axially movable tube and into synchronism therewith;

d. means for moving said knife array against said tube when the carriage having said knife array is synchronized in speed with said axially moving tube;

e. each of said carriages including sensing means for sensing said registration indicia for synchronizing the movement of said carriages;

f. means operable in response to said sensing means for varying the speed of advance of said axially movable tube whereby said knife array cuts said tube on the registration indicia without the formation of waste in said tube.

6. A machine, for the production of helically wound tubular bodies from strip material, comprising:

a. means for winding strip material on a mandrel to form a tube having recurring registration indicia thereon and for moving the tube axially along the mandrel;

b. a pair of carriages each having a knife array thereon and being movable into position to cut said tube into individual bodies along the registration indicia between each body;

c. means for moving each of said carriages axially with respect to said axially movable tube and into synchronism therewith;

d. means for moving said knife array against said tube when the carriage having said knife array is synchronized in speed with said axially moving tube;

e. means for sensing said indicia;

f. means operable in response to said sensing means for varying the speed of advance of said axially movable tube whereby said knife array cuts said tube on the registration indicia without the formation of waste in said tube;

g. means for docking said carriages for movement in unison, including means on each carriage for synchronizing movement with said registration indicia irrespective of whether said carriages are in docked relationship.

7. A machine, for the production of helically wound tubular bodies from strip material, comprising:

a. means for winding strip material on a mandrel to form a tube having recurring registration indicia thereon and for moving the tube axially along the mandrel;

b. a pair of carriages each having a knife array thereon and being movable into position to cut said tube into individual bodies along the registration indicia between each body;

c. means for moving each of said carriages axially with respect to said axially movable tube and into synchronism therewith;

d. means for moving said knife array against said tube when the carriage having said knife array is synchronized in speed with said axially moving tube;

e. means for sensing said indicia;

f. means operable in response to said sensing means for varying the speed of advance of said axially movable tube whereby said knife array cuts said tube on the registration indicia without the formation of waste in said tube;

g. said carriages including means for maintaining said carriages in relationship for movement in unison for docking said carriages;

h. each of said carriages having a docking structure engageable with a mating docking structure on the other carriage;

i. said docking structures being released for retracting movement of a carriage at the end of its advance movement.

* * * * *